US011208258B2

(12) United States Patent
Chen

(10) Patent No.: US 11,208,258 B2
(45) Date of Patent: Dec. 28, 2021

(54) CUP LID AND CUP LID ATTACHED WITH TEA BAG

(71) Applicant: Three Taste Tea Co., LTD., Keelung (TW)

(72) Inventor: Hsien-Chin Chen, Keelung (TW)

(73) Assignee: Three Taste Tea Co., LTD., Keelung (TW)

( * ) Notice: Subject to any disclaimer, the term of this patent is extended or adjusted under 35 U.S.C. 154(b) by 661 days.

(21) Appl. No.: 16/100,164

(22) Filed: Aug. 9, 2018

(65) Prior Publication Data

US 2020/0047989 A1 Feb. 13, 2020

(51) Int. Cl.

| | |
|---|---|
| ***B65D 85/812*** | (2006.01) |
| ***B65D 43/02*** | (2006.01) |
| ***B65D 51/24*** | (2006.01) |

(52) U.S. Cl.

CPC ..... *B65D 85/812* (2013.01); *B65D 51/24* (2013.01); *B65D 43/0222* (2013.01); *B65D 2543/00046* (2013.01)

(58) Field of Classification Search

CPC .... B65D 50/061; B65D 51/241; B65D 51/24; B65D 51/26; B65D 85/812; B65D 85/8085; B65D 51/18; B65D 43/02; G09F 2003/027

USPC ..... 215/206, 230, 228, 227; 40/311, 310; 426/435

See application file for complete search history.

(56) References Cited

U.S. PATENT DOCUMENTS

| | | | | |
|---|---|---|---|---|
| 7,913,867 | B2 * | 3/2011 | Phillips | B65D 85/812 220/254.2 |
| 8,651,316 | B2 * | 2/2014 | Portman | B65D 85/812 220/712 |
| 9,107,541 | B2 * | 8/2015 | Bodum | A47J 31/44 |
| 9,908,667 | B1 * | 3/2018 | Smith | B65D 51/18 |
| 2006/0273093 | A1 | 12/2006 | Portman et al. | |
| 2012/0201941 | A1 * | 8/2012 | Lavoie | B65D 85/812 426/435 |

(Continued)

FOREIGN PATENT DOCUMENTS

| | | | |
|---|---|---|---|
| CN | 201055213 | Y | 5/2008 |
| CN | 201171566 | Y | 12/2008 |

(Continued)

OTHER PUBLICATIONS

Office Action of China Patent Application No. 201710254646.6 dated Aug. 9, 2019.

*Primary Examiner* — Anthony D Stashick
*Assistant Examiner* — Raven Collins
(74) *Attorney, Agent, or Firm* — Idea Intellectual Limited; Margaret A. Burke; Sam T. Yip

(57) ABSTRACT

A cup lid includes a lid body and a label placement structure. A sip hole structure and a through hole are formed at different positions on a top surface of the lid body, and the sip hole structure includes a flip-top lid, a protruding buckle formed on the flip-top lid, and a buckle groove located on one side of the flip-top lid; and the label placement structure is disposed on the top surface of the lid body, where the label placement structure includes a plurality of clamping arms protruding from the top surface of the lid body, and when a label is inserted into the label placement structure, the clamping arms clamp two sides of the label. In addition, a cup lid attached with a tea bag is also provided.

16 Claims, 15 Drawing Sheets

(56) References Cited

U.S. PATENT DOCUMENTS

2014/0158693 A1 6/2014 Portman et al.

FOREIGN PATENT DOCUMENTS

| | | | |
|---|---|---|---|
| CN | 201295072 | Y | 8/2009 |
| CN | 103859920 | A | 6/2014 |
| CN | 205293552 | U | 6/2016 |
| CN | 207506320 | U | 6/2018 |
| JP | 62182245 | U | 11/1987 |
| JP | H08217101 | A | 8/1996 |
| JP | 2006176169 | A | 7/2006 |
| JP | 2013027971 | A | 2/2013 |
| TW | M462556 | U | 10/2013 |

* cited by examiner

CUP LID AND CUP LID ATTACHED WITH TEA BAG

FIELD OF THE INVENTION

The present invention relates to a cup lid, and in particular, to a cup lid having a label placement structure.

BACKGROUND

Culture of tea bag drinks has a long history, there is a plurality of forms and types of the tea bag drinks, for example, tea, coffee, and scented tea, and drinks have become an indispensable dietary habit of people. In the current society, it can be seen at any time that everyone has a cup of hand or brewing drink. Therefore, a disposable teacup and cup lid can be more conveniently used by busy moderns.

For a cup lid available and used on the market, it is inconvenient for a user to control a drawstring to decide whether a tea bag needs to be soaked and control a concentration of tea in a cup.

In addition, during soaking of the tea bag, a label randomly shakes outside the cup lid, causing inconvenience for the user during carrying and drinking.

SUMMARY OF THE INVENTION

The present invention provides a cup lid. In an embodiment, the cup lid includes a lid body and a label placement structure. A sip hole structure and a through hole are formed at different positions on a top surface of the lid body, and the sip hole structure includes a flip-top lid, a protruding buckle formed on the flip-top lid, and a buckle groove located on one side of the flip-top lid; and the label placement structure is disposed on the top surface of the lid body, where the label placement structure includes a plurality of clamping arms protruding from the top surface of the lid body, and when a label is inserted into the label placement structure, the clamping arms clamp two sides of the label.

In an embodiment, the cup lid further includes a recess formed on the top surface of the lid body, where the label placement structure is disposed in the recess.

In an embodiment, the cup lid further includes a recess formed on the top surface of the lid body, where the sip hole structure is disposed in the recess, and the label placement structure is disposed on the flip-top lid of the sip hole structure.

In an embodiment, the cup lid further includes a first guiding groove and a second guiding groove, where the first guiding groove is located on the top surface of the lid body and extends from a bottom end of the recess toward the through hole, and the second guiding groove extends from a top end of the recess to a periphery of the lid body.

In an embodiment, the cup lid further includes a third guiding groove extending from the buckle groove to a periphery of the lid body in a direction away from the sip hole structure.

In an embodiment, the cup lid further includes a partition board disposed below the top surface of the lid body and located inside the lid body, where an upper end of the partition board and the lid body are connected to each other between the sip hole structure and the through hole.

In an embodiment, the cup lid further includes at least one supporting plate located inside the lid body and respectively connected to the lid body and the partition board, where the supporting plate, the lid body and the partition board are located in different planes.

In an embodiment, a bottom portion of the lid body includes a protruding outer edge, and the protruding outer edge is provided with a hook portion.

In an embodiment, an inner wall surface of the lid body includes a threaded structure.

The present invention further provides a cup lid attached with a tea bag. In an embodiment, the cup lid attached with a tea bag includes the forgoing cup lid and a tea bag. The tea bag includes a body, a drawstring and a label, where the body is located inside the lid body, the label is placed on the label placement structure, one end of the drawstring is connected to the label, and the other end of the drawstring is connected to the body through the through hole.

In an embodiment, the cup lid further includes a recess formed on the top surface of the lid body, where the label placement structure is disposed in the recess.

In an embodiment, the cup lid further includes a recess formed on the top surface of the lid body, where the sip hole structure is disposed in the recess, and the label placement structure is disposed on the flip-top lid of the sip hole structure.

In an embodiment, the cup lid further includes a first guiding groove and a second guiding groove, where the first guiding groove is formed on the top surface of the lid body and extends from a bottom end of the recess toward the through hole, and the second guiding groove extends from a top end of the recess to a periphery of the lid body.

In an embodiment, the cup lid further includes a third guiding groove extending from the buckle groove to a periphery of the lid body in a direction away from the sip hole structure.

In an embodiment, the cup lid further includes a partition board disposed below the top surface of the lid body and located inside the lid body, where an upper end of the partition board and the lid body are connected to each other between the sip hole structure and the through hole, the partition board includes a first surface and a second surface opposite to the first surface, and the first surface faces the body.

In an embodiment, the cup lid further includes at least one supporting plate located inside the lid body and respectively connected to the lid body and the partition board, where the supporting plate, the lid body and the partition board are located in different planes.

In an embodiment, a bottom portion of the lid body includes a protruding outer edge, the protruding outer edge is provided with a hook portion, the label detaches from the label placement structure in a withdrawal state, and the label drags the drawstring to be attached to the hook portion to fix the label.

In an embodiment, an inner wall surface of the lid body includes a threaded structure.

An embodiment of the cup lid in the present invention provides a user with a convenient drinking manner, the label of the tea bag may be placed on the label placement structure without randomly shaking. When the user pulls the label, the cup lid includes the first and second guiding grooves (or the third guiding groove) to help the drawstring to move. Further, the cup lid includes the partition board effectively partitioning the body of the tea bag inside the lid body, so that when the user drinks, the body of the tea bag does not fall under the sip hole structure and block the sip hole structure. Therefore, the body of the tea bag does not hamper drinking of the user, and it is quite convenient to use the cup lid.

DETAILED DESCRIPTION OF THE INVENTION

Figure 1:
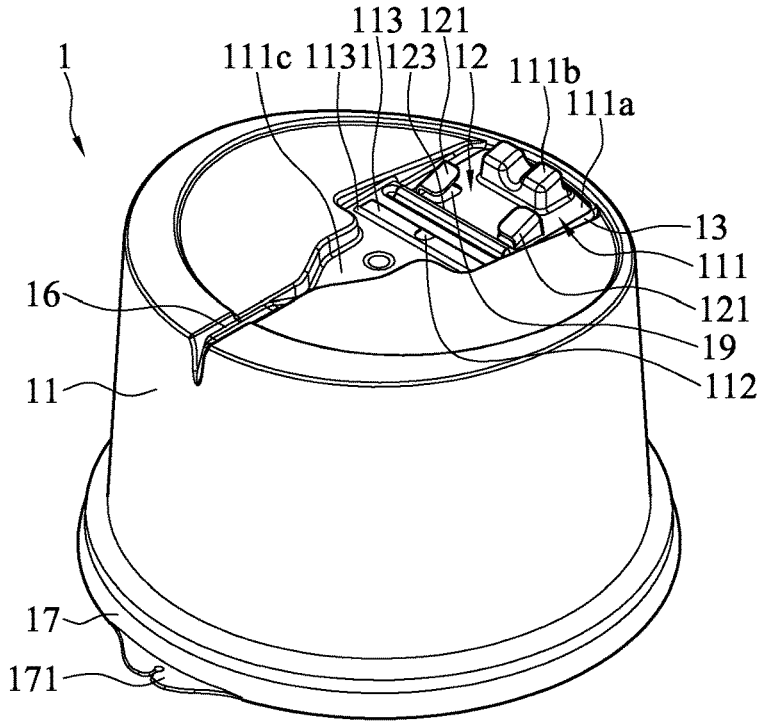
FIG. 1 is a schematic three-dimensional diagram of a first embodiment of a cup lid according to the present invention.

Referring to FIG. 1 to FIG. 4, FIG. 1 to FIG. 4 are schematic three-dimensional diagrams of first to fourth embodiments of a cup lid 1 according to the present invention. The cup lid 1 includes a lid body 11 and a label placement structure 12. A sip hole structure 111 and a through hole 112 are formed at different positions on a top surface of the lid body 11, the sip hole structure 111 includes a flip-top lid 111*a*, a protruding buckle 111*b* formed on the flip-top lid 111*a*, and a buckle groove 111*c* located on one side of the flip-top lid 111*a*. In an embodiment (for example, the first or third embodiment), a grid sheet structure 113 is included on the lid body 11, the through hole 112 is provided on the grid sheet structure 113, and a protruding shaft 1131 is included on one side of the grid sheet structure 113, so that the grid sheet structure 113 may invert on the lid body 11. The grid sheet structure 113 has the following functions: (1) providing a channel through which a label of a tea bag passes; (2) preventing the label from falling into a cup body during drinking or carrying; and (3) helping heat dissipation. The through hole 112 provides a channel through which a drawstring of the tea bag moves. The label placement structure 12 is disposed on the top surface of the lid body 11, the label placement structure 12 includes a plurality of clamping arms 121 protruding from the top surface of the lid body 11, and when the label is inserted into the label placement structure 12, the clamping arms 121 clamp two sides of the label. In the first and third embodiments, a hole 19 is included below the clamping arm 121, and may be provided on the lid body 11 based on a requirement (heat dissipation or a structure design) of a user. The present invention is not limited thereto.

Figure 2:
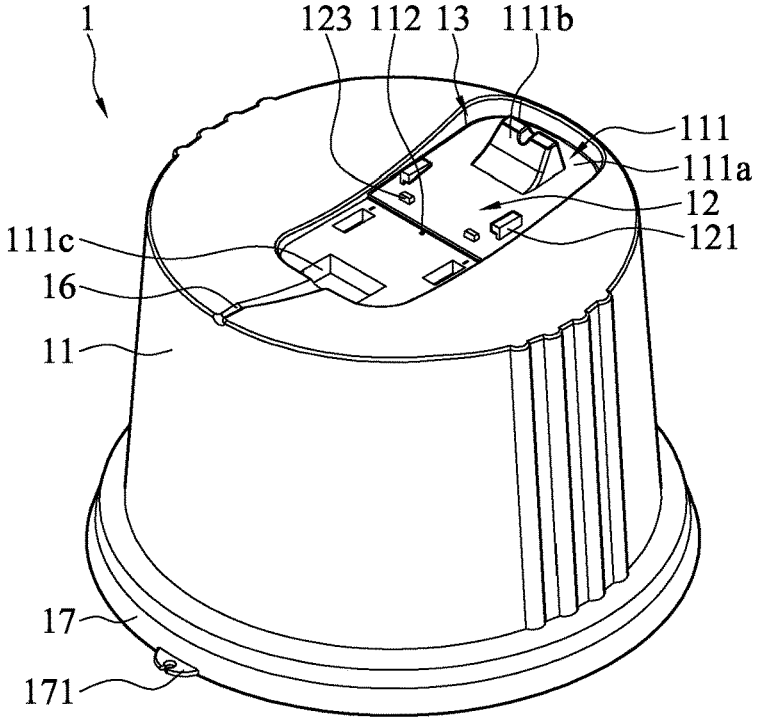
FIG. 2 is a schematic three-dimensional diagram of a second embodiment of a cup lid according to the present invention.

The sip hole structure 111 provides a channel for a user to drink. In a normal state, the flip-top lid 111*a* closes an opening of the sip hole structure 111, when the user drinks, the flip-top lid 111*a* may be inverted, and the flip-top lid 111*a* is fixed by using a structure of the protruding buckle 111*b* and the buckle groove 111*c*. In the second embodiment, as shown in FIG. 2, a notch structure is included on the protruding buckle 111*b*. The structure is designed to avoid affecting movement of the drawstring of the tea bag when the flip-top lid 111*a* is fixed by using the structure of the protruding buckle 111*b* and the buckle groove 111*c*. In other words, when the protruding buckle 111*b* is buckled with the buckle groove 111*c*, a channel is formed between the notch structure and the buckle groove 111*c*, so that the drawstring of the tea bag is not affected during moving.

Figure 3:
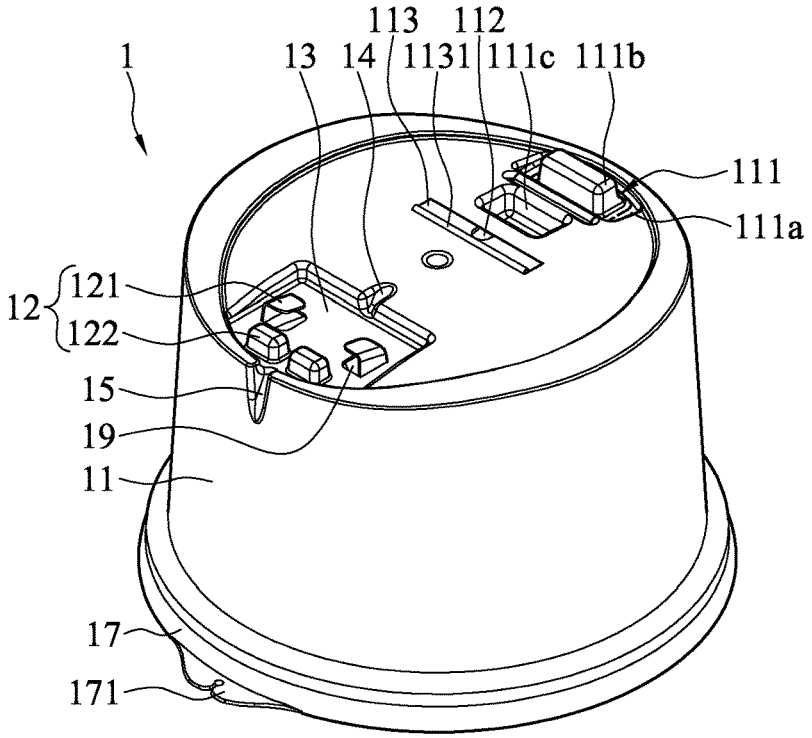
FIG. 3 is a schematic three-dimensional diagram of a third embodiment of a cup lid according to the present invention.
Figure 4:
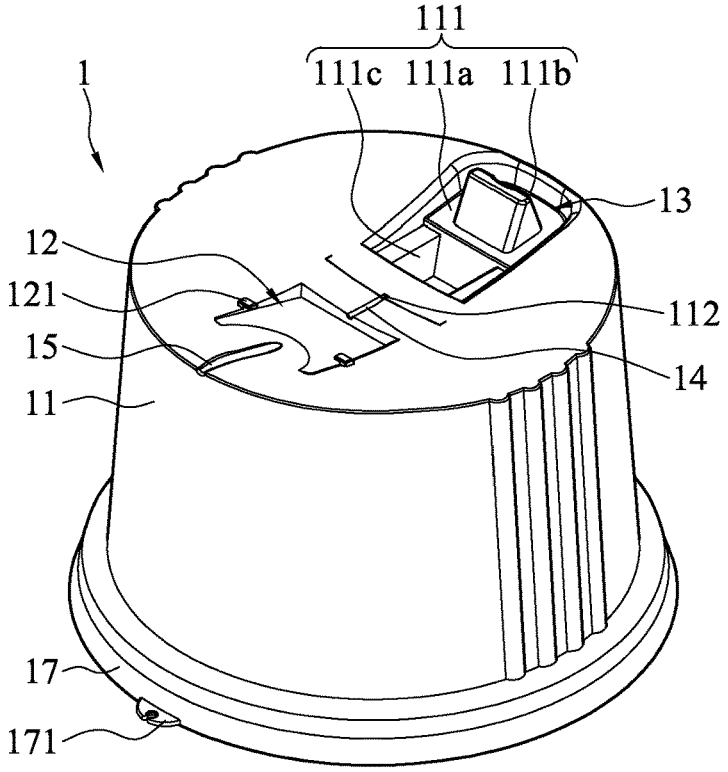
FIG. 4 is a schematic three-dimensional diagram of a fourth embodiment of a cup lid according to the present invention.

As shown in FIG. 1 to FIG. 4, the label placement structure 12 provides space for the label to be placed. When the label is inserted into the label placement structure 12, the clamping arms 121 clamp the two sides of the label to prevent the label from randomly shaking outside the lid body 11. In the second embodiment, the label placement structure 12 further includes an auxiliary structure 122, and the auxiliary structure 122 may help the label of the tea bag to abut against the label placement structure 12, so that the label does not exceed a range accommodated by the label placement structure, as shown in FIG. 2. The auxiliary structure 122 alternatively helps the user withdraw the label. For example, in the third embodiment, the auxiliary structure 122 bulges a placed label to make it inclined. This helps the user withdraw the label, as shown in FIG. 3.

Compared with the third embodiment and the fourth embodiment, in the first embodiment and the second embodiment, the label placement structure 12 further includes an abutting portion 123, and the abutting portion 123 may abut against a bottom portion of the label of the tea bag, so that the label does not easily slide down or fall down. The abutting portion 123 in the first embodiment is a protruding rod structure having a height difference, and the abutting portions 123 in the second embodiment are two bump structures. The present invention is not limited thereto.

The cup lid 1 further includes a recess 13, the recess 13 is formed on the top surface of the lid body 11, and in the first to third embodiments, the label placement structure 12 is disposed in the recess 13 (as shown in FIG. 1 to FIG. 3). In the third embodiment, a bottom portion of the recess serves as a component for abutting the label of the tea bag. In another aspect, in the fourth embodiment, a bottom end of the label placement structure 12 is used for abutting the label of the tea bag.

In the first and second embodiments, one of differences from the third and fourth embodiments lies in that the sip hole structure 111 is disposed in the recess 13, and the label placement structure 12 is disposed on the flip-top lid 111*a* of the sip hole structure 111.

In addition, in the first and second embodiments, the cup lid 1 further includes a third guiding groove 16. For helping the user pull the label and the drawstring, the third guiding groove 16 extends from the buckle groove 111*c* to a periphery of the lid body 11 in a direction away from the sip hole structure 111, as shown in FIG. 1 and FIG. 2. In other embodiments, different from the first and second embodiments, for example, in the third and fourth embodiments, the cup lid 1 further includes a first guiding groove 14 and a second guiding groove 15, the first guiding groove 14 is located on the top surface of the lid body 11 and extends from a bottom end of the recess 13 toward the through hole 112, and the second guiding groove 15 extends from a top end of the recess 13 to a periphery of the lid body 11. Structures of the first guiding groove 14 and the second guiding groove 15 are different from a structure of the third guiding groove 16, and all of the structures help the user pull the label and the drawstring.

Then, referring to FIG. 1 to FIG. 4 again, in the first to fourth embodiments, a bottom portion of the lid body 11 includes a protruding outer edge 17, the protruding outer edge 17 is provided with a hook portion 171, and the hook portion 171 provides a function of fixing the label and the drawstring.

Referring to FIG. 2 and FIG. 4 again, in the second and fourth embodiments, one of differences from the first and third embodiments lies in that a plurality of protruding columns is included on a side wall of the lid body 11 in the second and fourth embodiments. This design helps increase whole supporting strength of the cup lid 1 and has an aesthetic effect.

Figure 5:
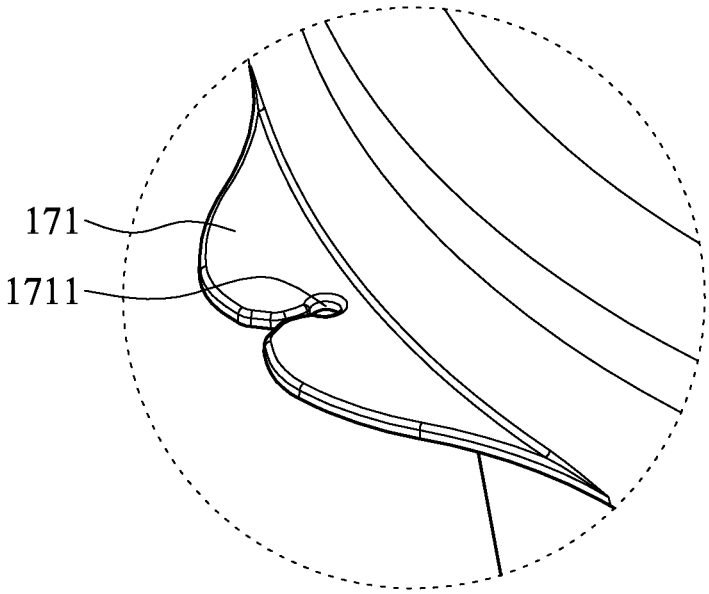
FIG. 5 is a schematic three-dimensional diagram of an embodiment of a hook portion of a cup lid according to the present invention.
Figure 6:
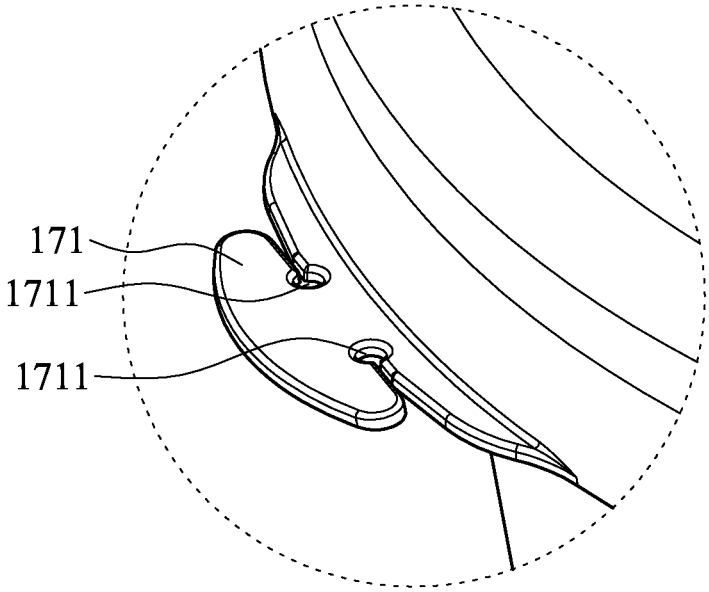
FIG. 6 is a schematic three-dimensional diagram of an embodiment of a hook portion of a cup lid according to the present invention.
Figure 7A:
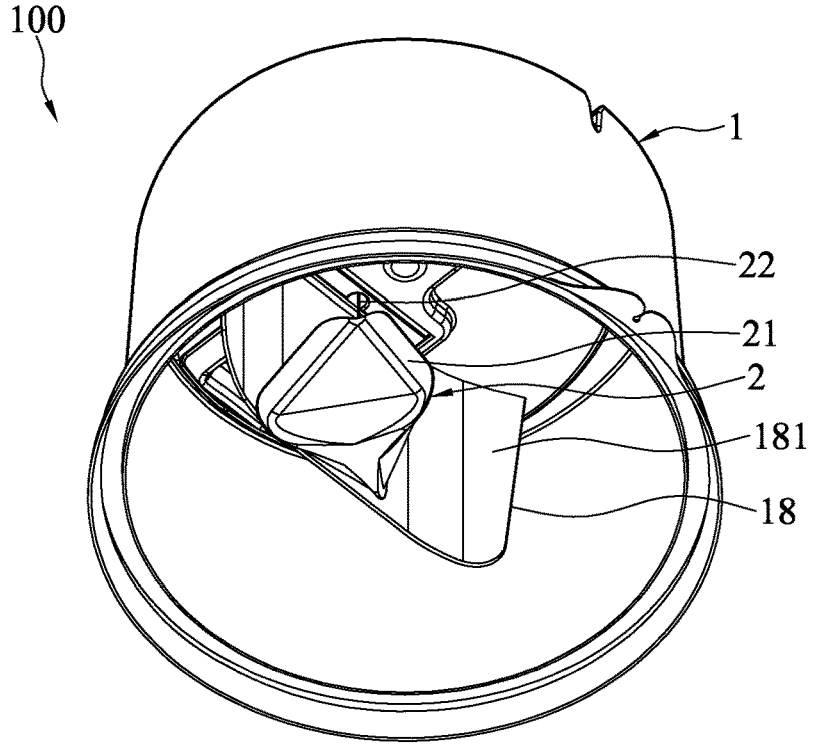
FIG. 7A and FIG. 7B are a partial schematic diagram and a schematic bottom view of a first embodiment of a cup lid according to the present invention.
Figure 7B:
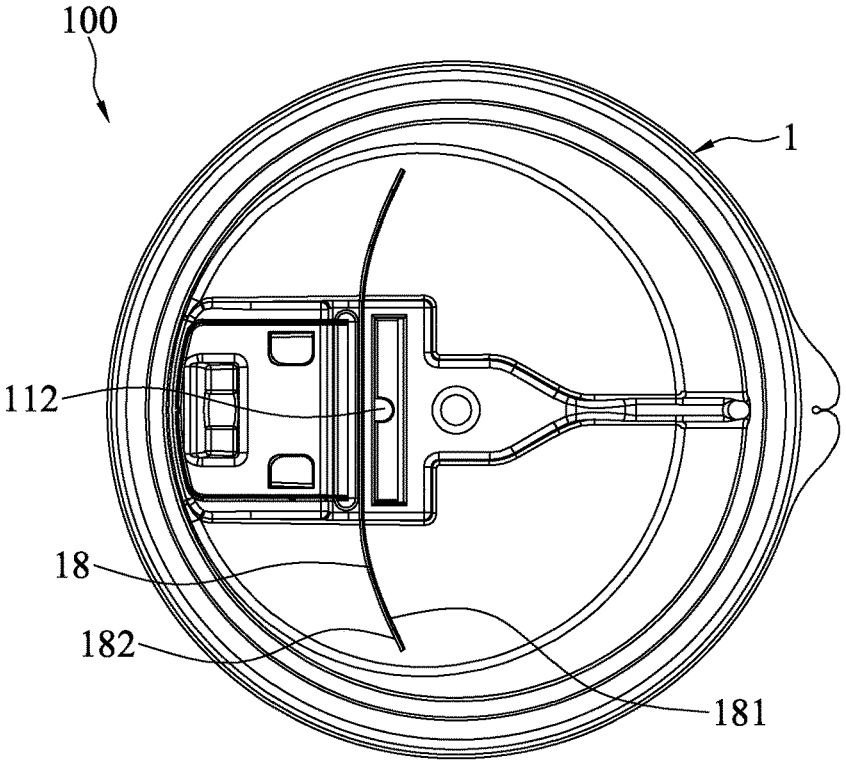
Figure 8A:
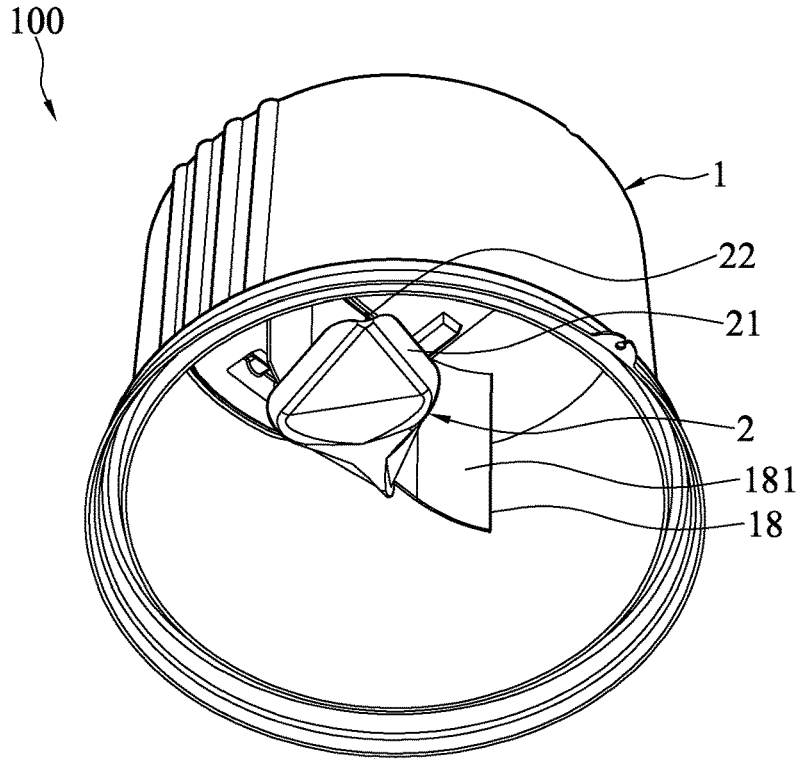
FIG. 8A and FIG. 8B are a partial schematic diagram and a schematic bottom view of a second embodiment of a cup lid according to the present invention.
Figure 8B:
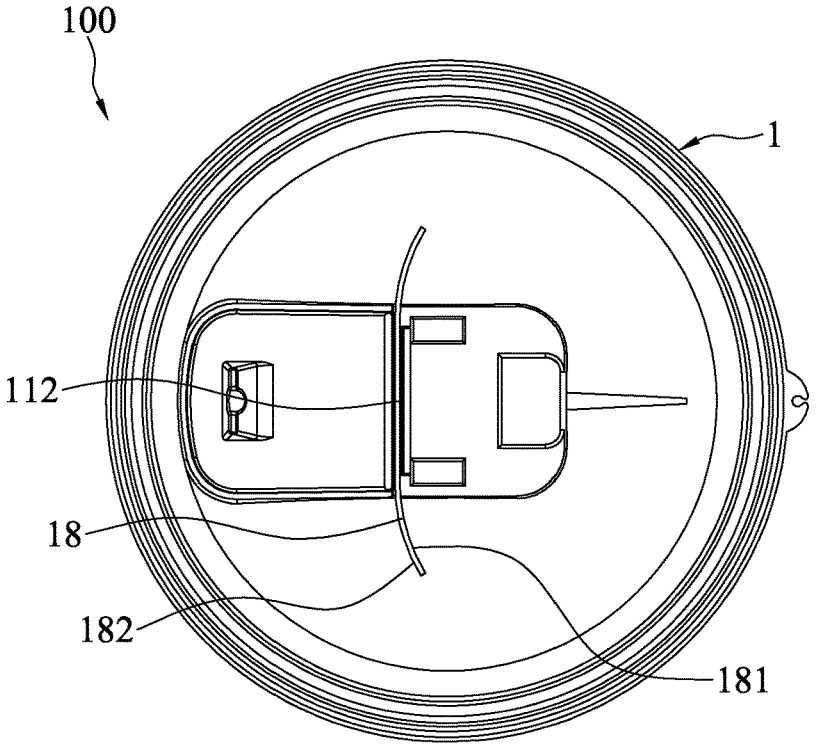
Figure 9A:
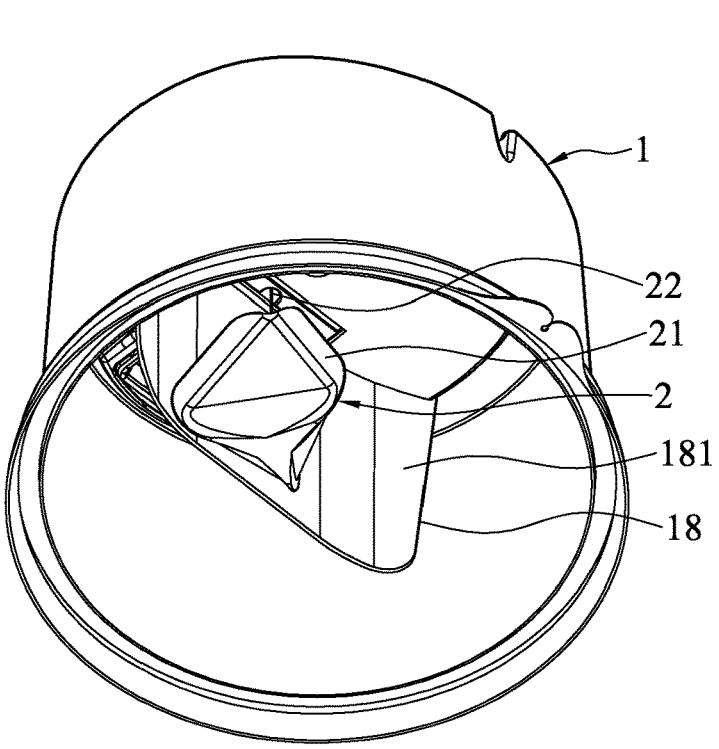
FIG. 9A and FIG. 9B are a partial schematic diagram and a schematic bottom view of a third embodiment of a cup lid according to the present invention.
Figure 9B:
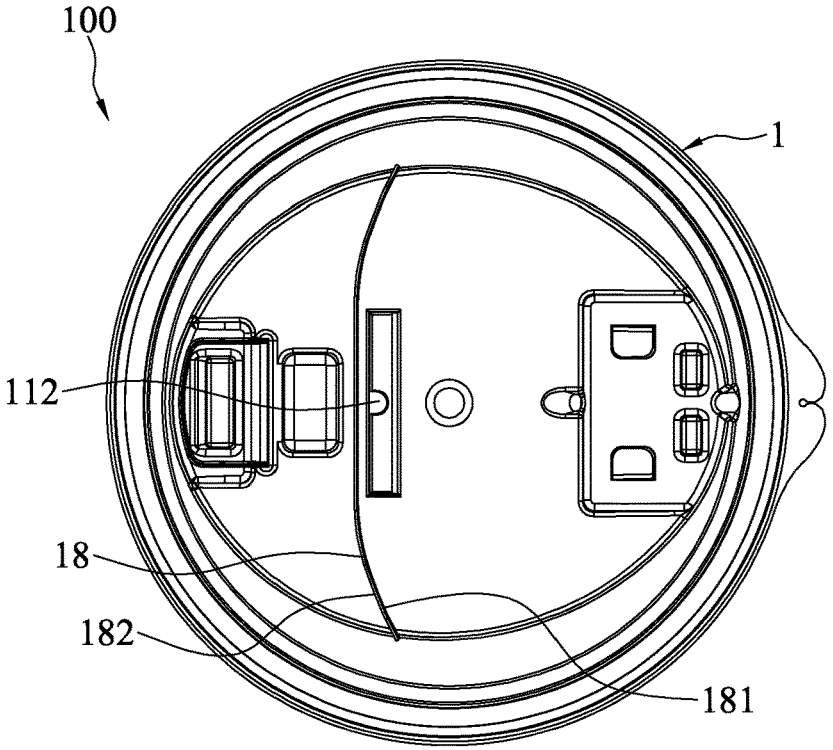
Figure 10A:
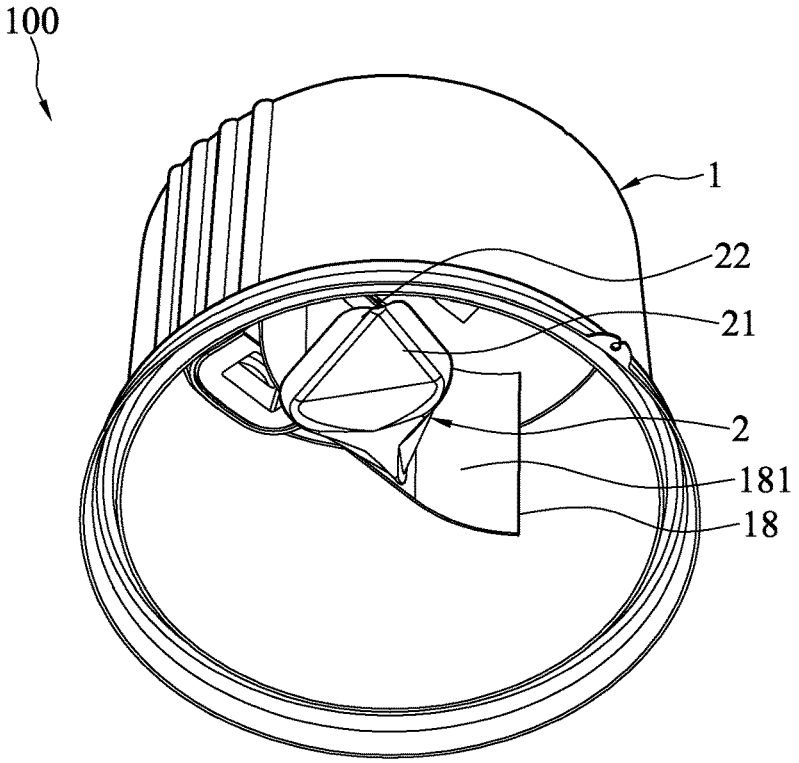
FIG. 10A and FIG. 10B are a partial schematic diagram and a schematic bottom view of a fourth embodiment of a cup lid according to the present invention.
Figure 10B:
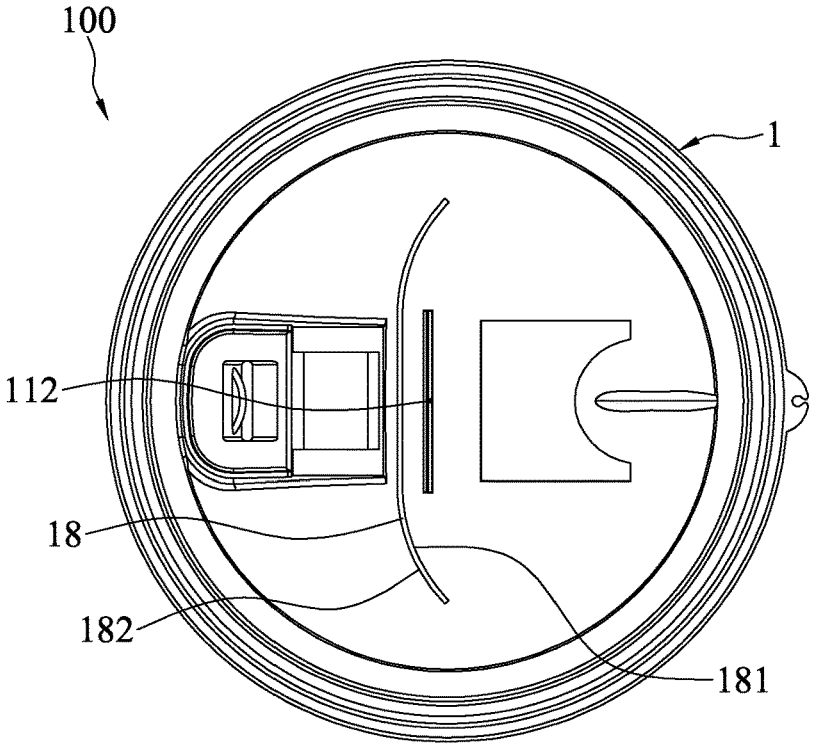
Figure 11A:
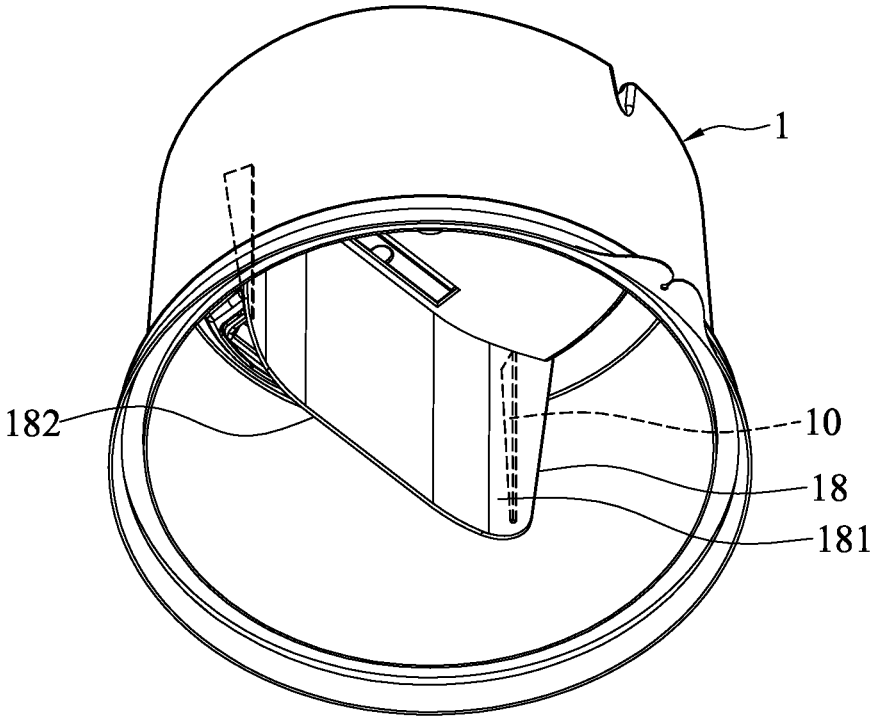
FIG. 11A and FIG. 11B are a partial schematic diagram and a schematic bottom view of an embodiment of a cup lid according to the present invention.
Figure 11B:
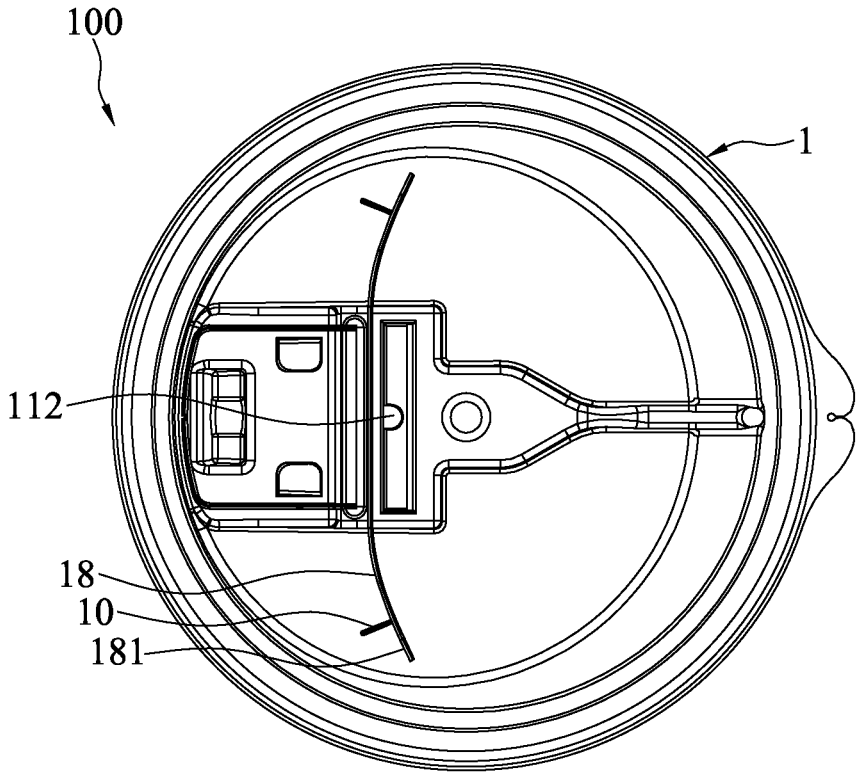

Referring to FIG. 5 and FIG. 6, each of FIG. 5 and FIG. 6 is a schematic three-dimensional diagram of an embodiment of a hook portion of a cup lid according to the present invention. A structure of the hook portion 171 may be designed to include a notch 1711 (as shown in FIG. 5) or include two notches (as shown in FIG. 6). The notch may also have a structure of a chamfer cut. The present invention is not limited thereto. When the user considers that a time for soaking the tea bag already meets a requirement (when tea already reaches a required concentration) and no soaking is needed, the user withdraws the label from the label placement structure 12 and drives the drawstring to move to the hook portion 171 to be fixed. In this case, a body of the tea bag detaches from a liquid surface and reaches inside the lid body 11. In an embodiment, with the foregoing first guiding groove 14 and second guiding groove 15 (or only the third guiding groove 16), the user may easily withdraw the label and the drawstring, and wind and fix the label and the drawstring on the hook portion 171, or directly clamp and fix the label and the drawstring on the notch in a manner of no winding. In an embodiment, the hook portion 171 including a notch 1711 may directly embed and fix the drawstring and the label of the tea bag, the hook portion 171 including two notches 1711 may fix the drawstring and the label of the tea bag in a manner of winding, and the user may drink tea after the drawstring and the label of the tea bag are fixed. Relatively, when the user intends to further soak the tea bag, the user loosens the label and the drawstring from the hook portion 171 so that the tea bag soaks in the tea, the user may place the label in the label placement structure 12 again, and the operation is quite convenient.

Referring to FIG. 7A to FIG. 10B, FIG. 7A, FIG. 8A, FIG. 9A and FIG. 10A are partial schematic diagrams of first to fourth embodiments of a cup lid 1 according to the present invention. FIG. 7B, FIG. 8B, FIG. 9B and FIG. 10B are schematic bottom views of first to fourth embodiments of a cup lid 1 according to the present invention. The cup lid 1 further includes a partition board 18 disposed below the top surface of the lid body 11 and located inside the lid body 11, an upper end of the partition board 18 and the lid body 11 are connected to each other between the sip hole structure 111 and the through hole 112, the partition board 18 may have a straight or arc-shaped structure or a structure having curvature, the partition board 18 includes a first surface 181 and a second surface 182 opposite to the first surface 181, and when a tea bag 2 is in the cup lid 1, the first surface 181 faces a body 21 of the tea bag 2. In other words, the partition board 18 effectively partitions the body 21 of the tea bag 2 inside the lid body 11, so that when the user drinks, the body 21 of the tea bag 2 does not fall under the sip hole structure 111 and block the opening of the sip hole structure 111.

Figure 12A:
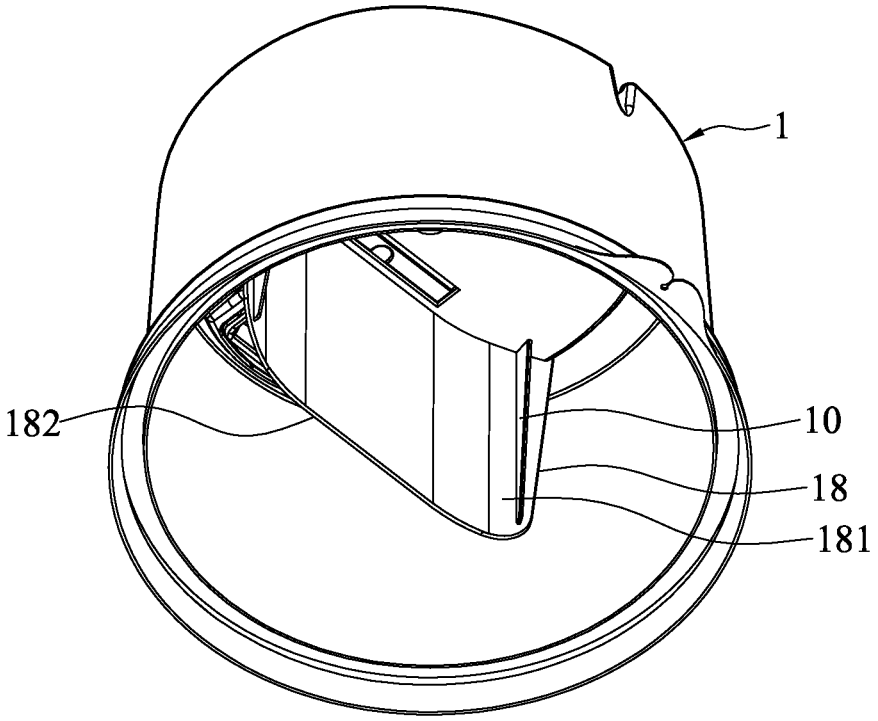
FIG. 12A and FIG. 12B are a partial schematic diagram and a schematic bottom view of another embodiment of a cup lid according to the present invention.
Figure 12B:
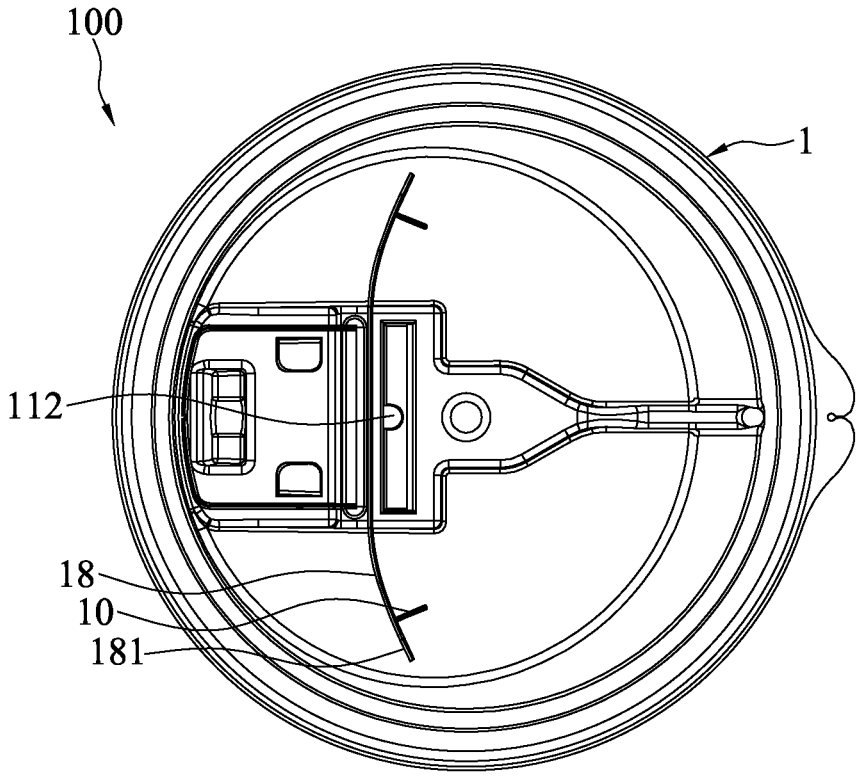
Figure 13:
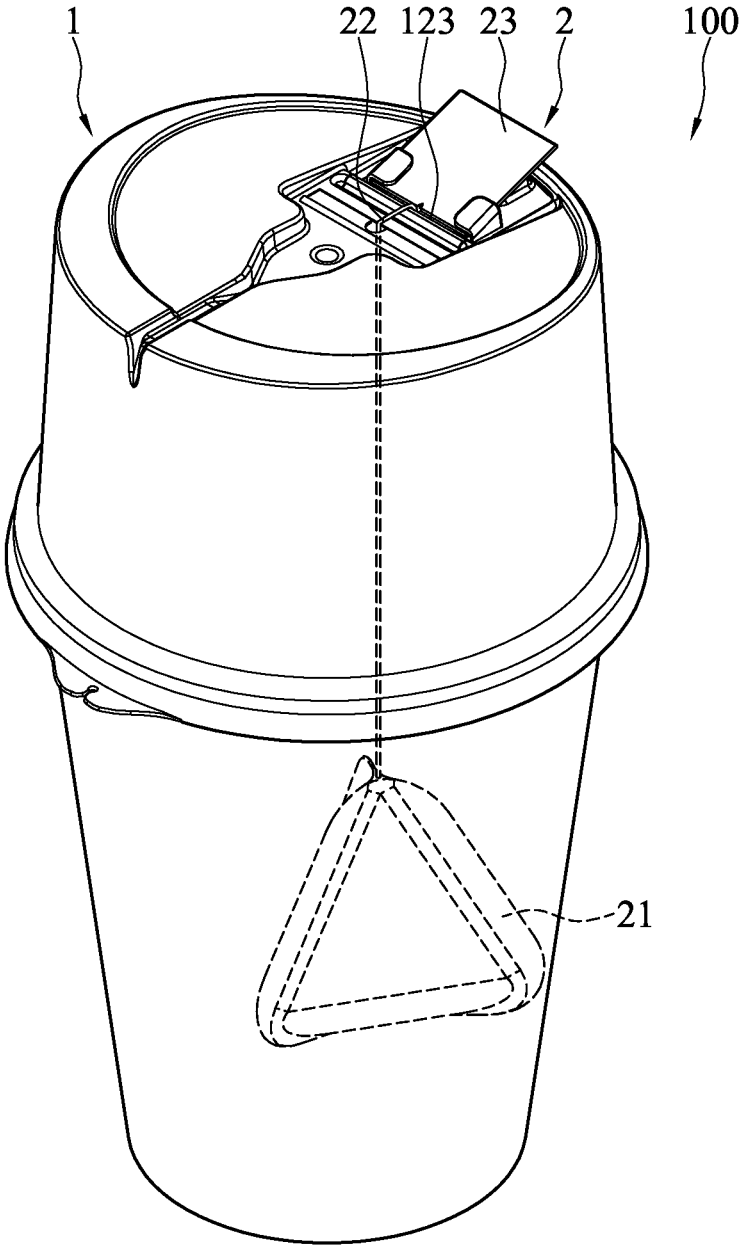
FIG. 13 is a schematic three-dimensional diagram of a first embodiment of a cup lid attached with a tea bag according to the present invention.
Figure 14:
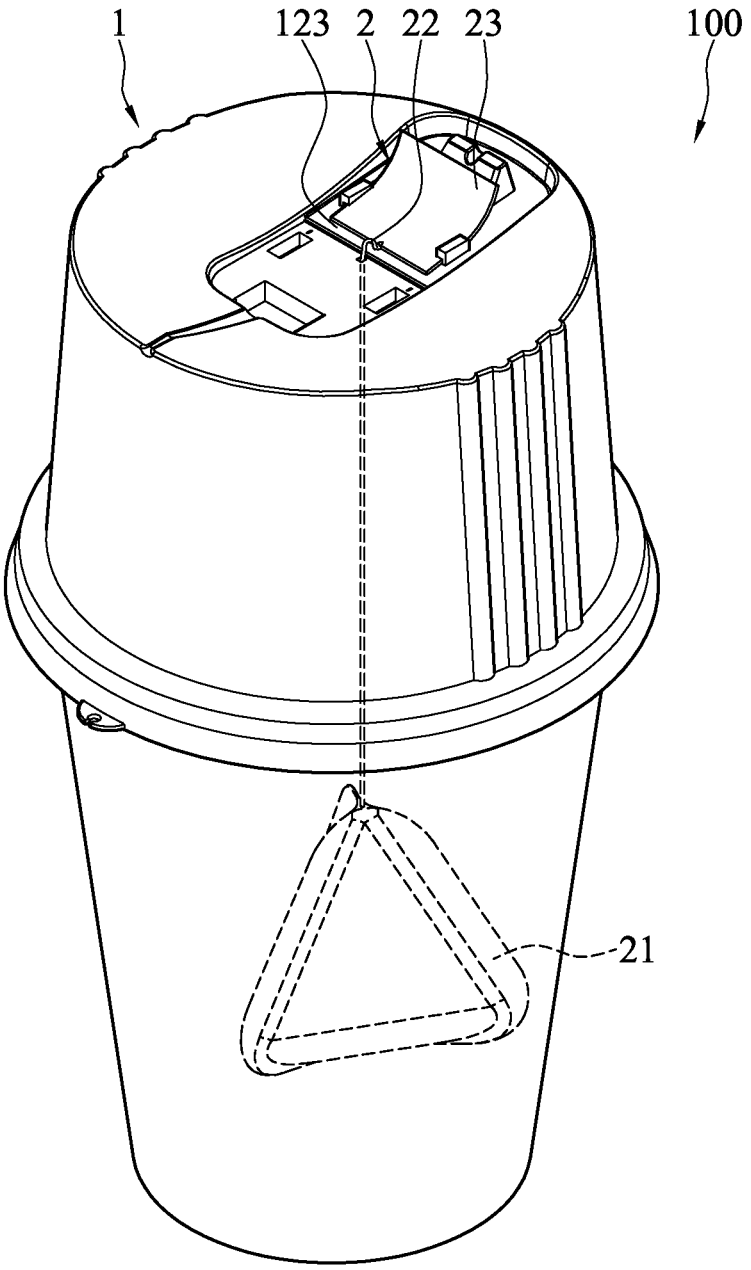
FIG. 14 is a schematic three-dimensional diagram of a second embodiment of a cup lid attached with a tea bag according to the present invention.
Figure 15:
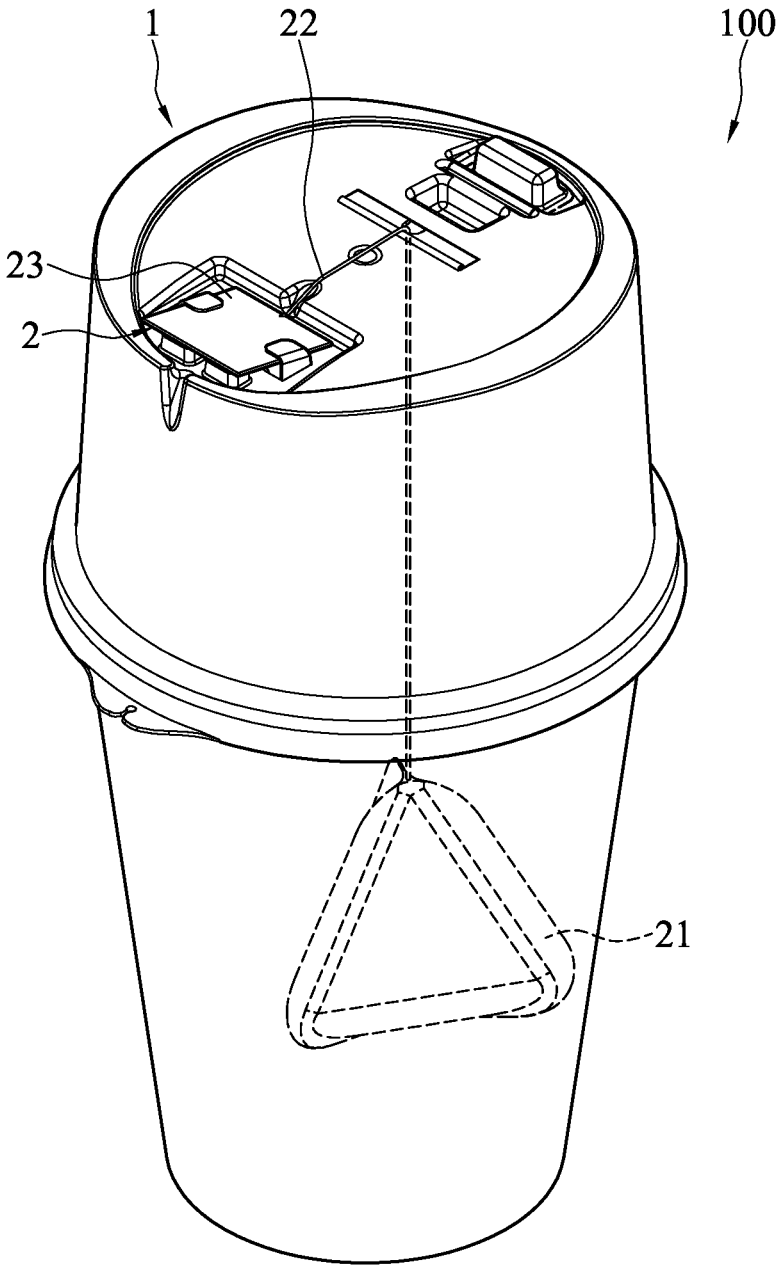
FIG. 15 is a schematic three-dimensional diagram of a third embodiment of a cup lid attached with a tea bag according to the present invention.
Figure 16:
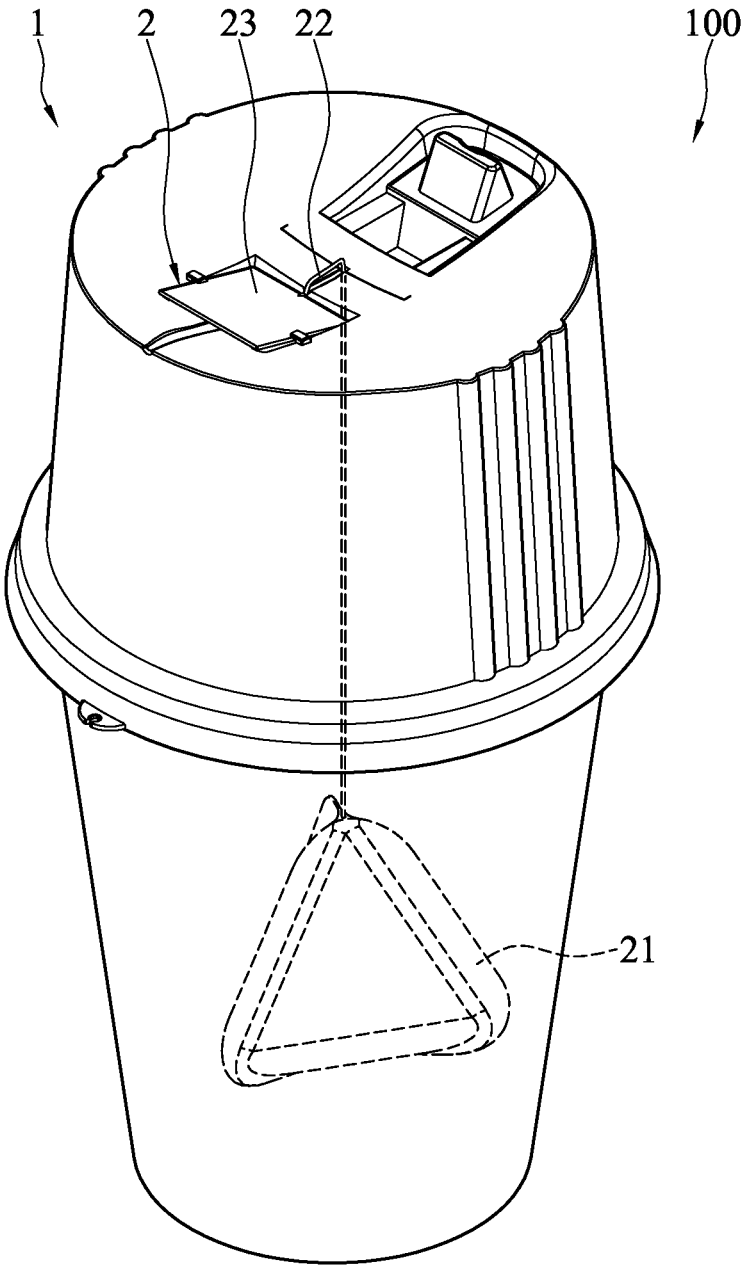
FIG. 16 is a schematic three-dimensional diagram of a fourth embodiment of a cup lid attached with a tea bag according to the present invention.

Referring to FIG. 11A to FIG. 12B, FIG. 11A and FIG. 11B are a partial schematic diagram and a schematic bottom view of an embodiment of a cup lid 1 according to the present invention. FIG. 12A and FIG. 12B are a partial schematic diagram and a schematic bottom view of another embodiment of a cup lid 1 according to the present invention. Herein, the first embodiment is used for description. The cup lid 1 further includes at least one supporting plate 10 located inside the lid body 11 and respectively connected to the lid body 11 and the partition board 18, and the supporting plate 10, the lid body 11 and the partition board 18 are located in different planes. The supporting plate may be disposed on the foregoing first surface 181 or the second surface 182, the supporting plate 10 has a function of supporting the partition board 18 and prevents the partition board 18 from deforming and damaging due to being stricken by flowing of tea and abutting of the tea bag. In addition, if the supporting plate 10 is disposed on the first surface 181, the supporting plate 10 also has a function of limiting a position of the tea bag. In the foregoing second to fourth embodiments, the supporting plate 10 may also be disposed on the first surface 181 or the second surface 182 of the partition board. The present invention is not limited to the foregoing first embodiment.

Referring to FIG. 13 to FIG. 16, each of FIG. 13 to FIG. 16 is a schematic three-dimensional diagram of an embodiment of a cup lid 1 attached with a tea bag 2 according to the present invention. The cup lid 1 attached with a tea bag 2 includes a cup lid 1 and a tea bag 2. The cup lid 1 may be the cup lid 1 shown in any one of the foregoing embodiments, and the structure of the cup lid 1 is not described herein again. The tea bag 2 includes a body 21, a drawstring 22 and a label 23, the body 21 is located inside the lid body 11, the label 23 is placed on the label placement structure 12, one end of the drawstring 22 is connected to the label 23, and the other end of the drawstring 22 is connected to the body 21 through the through hole 112.

Figure 17:
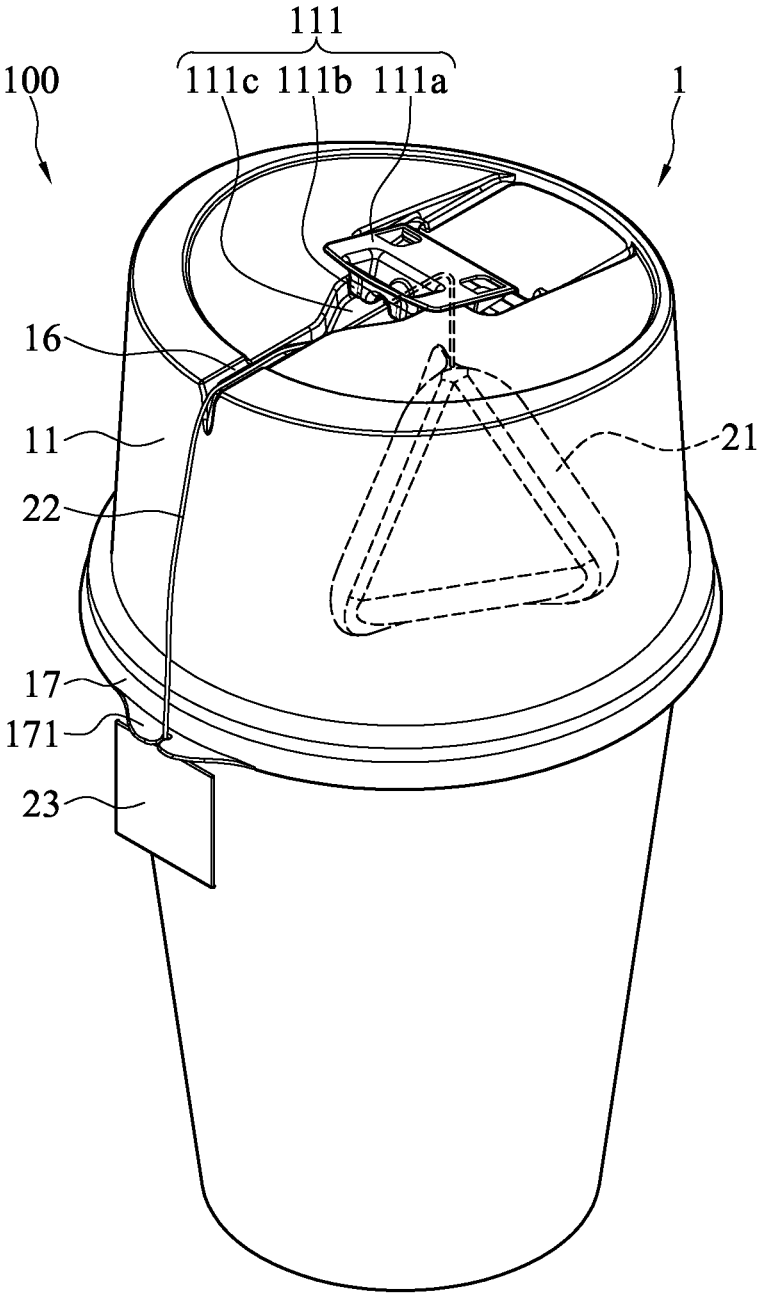
FIG. 17 is a schematic usage diagram of an embodiment of a cup lid according to the present invention.

Referring to FIG. 17, FIG. 17 is a schematic usage diagram of an embodiment of a cup lid 1 according to the present invention. As shown in the figure, the user uses a combination of the cup lid in the present invention and a cup body in which there is the tea bag and tea. When the user is to make tea, the label 23 of the tea bag may be disposed in the label placement structure 12. At a concentration that the user considers appropriate, the user makes the label detach from the label placement structure 12 in a withdrawal state by using the hook portion 171 on the protruding outer edge 17 at the bottom portion of the lid body 11, the label 23 drags the drawstring to be attached to and wound on the hook portion 171 or the label 23 is directly fixed. In this case, the user may randomly open the flip-top lid 111*a* to drink the tea, as shown in FIG. 17, the foregoing second to fourth embodiment also have a same usage aspect, a person of ordinary skill in the art may directly and unambiguously understand the foregoing implementation by using the cup lid, and therefore details are not described again.

Figure 18:
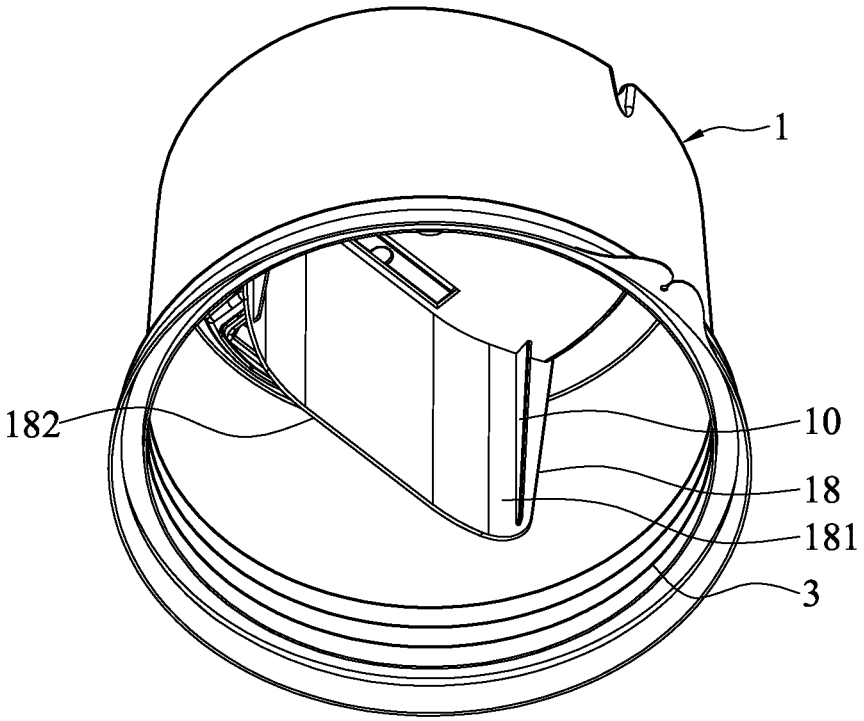
FIG. 18 is a schematic three-dimensional diagram of an embodiment of a cup lid according to the present invention.

Referring to FIG. 18, FIG. 18 is a schematic three-dimensional diagram of an embodiment of a cup lid 1 according to the present invention. In this embodiment, an inner wall surface of the lid body 11 includes a threaded structure 3. For example, an outer wall surface of a closed cup includes the other corresponding threaded structure. In this way, the user may lock the cup lid 1 on the cup in a manner of rotation. Leakproofness is good, thereby preventing liquid in a cup from leaking.

An embodiment of the cup lid in the present invention provides the label placement structure, so that the label does not randomly shake. In addition, the other embodiments provide the first and second guiding grooves (or the third guiding groove) to help the user pull the drawstring, and fix the label with the hook portion. This is more practical. In addition, to make the user smoothly drink, the cup lid in an embodiment further includes the partition board, the partition board may partition the body of the tea bag to slide to the sip hole structure to block the sip opening.

In the embodiments of the cup lid in the prevent invention, the foregoing structure features such as the label placement structure, the sip hole structure, the first guiding groove, the second guiding groove (or the third guiding groove), the hook portion and the partition board may be used in any combination based on a requirement of the user or a salesman, and are not limited to the embodiments in the present invention. The embodiments of the cup lid in the prevent invention provides the user with a cup lid that is easily operated, conveniently carried, and smooth during drinking.

Although the present invention has been described in considerable detail with reference to certain preferred embodiments thereof, the disclosure is not for limiting the scope of the invention. Persons having ordinary skill in the art may make various modifications and changes without departing from the scope and spirit of the invention. Therefore, the scope of the appended claims should not be limited to the description of the preferred embodiments described above.

What is claimed is:

1. A cup lid, comprising:

a lid body, wherein a sip hole structure and a through hole are formed at different positions on a top surface of the lid body, and the sip hole structure comprises a flip-top lid, a protruding buckle formed on the flip-top lid, and a buckle groove located on one side of the flip-top lid;

a label placement structure, disposed on the top surface of the lid body, wherein the label placement structure comprises a plurality of clamping arms protruding from the top surface of the lid body, and when a label is inserted into the label placement structure, the clamping arms clamp two sides of the label; and a recess formed on the top surface of the lid body, wherein the label placement structure is disposed in the recess.

2. The cup lid according to claim 1, further comprising a first guiding groove and a second guiding groove, wherein the first guiding groove is formed on the top surface of the lid body and extends from a bottom end of the recess toward the through hole, and the second guiding groove extends from a top end of the recess to a periphery of the lid body.

3. The cup lid according to claim 1, further comprising a partition board disposed below the top surface of the lid body and located inside the lid body, wherein an upper end of the partition board and the lid body are connected to each other between the sip hole structure and the through hole.

4. The cup lid according to claim 3, further comprising at least one supporting plate located inside the lid body and respectively connected to the lid body and the partition board, wherein the supporting plate, the lid body and the partition board are located in different planes.

5. The cup lid according to claim 1, wherein a bottom portion of the lid body comprises a protruding outer edge, and the protruding outer edge is provided with a hook portion.

6. The cup lid according to claim 1, wherein an inner wall surface of the lid body comprises a threaded structure.

7. A cup lid attached with a tea bag, comprising:

a cup lid, comprising:

a lid body, wherein a sip hole structure and a through hole are formed at different positions on a top surface of the lid body, and the sip hole structure comprises a flip-top lid, a protruding buckle formed on the flip-top lid, and a buckle groove located on one side of the flip-top lid; and a label placement structure, disposed on the top surface of the lid body, wherein the label placement structure comprises a plurality of clamping arms protruding from the top surface of the lid body, and when a label is inserted into the label placement structure, the clamping arms clamp two sides of the label; and a tea bag, comprising a body, a drawstring and a label, wherein the body is located inside the lid body, the label is placed on the label placement structure, one end of the drawstring is connected to the label, and the other end of the drawstring is connected to the body through the through hole.

8. The cup lid attached with a tea bag according to claim 7, further comprising a recess formed on the top surface of the lid body, wherein the label placement structure is disposed in the recess.

9. The cup lid attached with a tea bag according to claim 7, further comprising a recess formed on the top surface of the lid body, wherein the sip hole structure is disposed in the recess, and the label placement structure is disposed on the flip-top lid of the sip hole structure.

10. The cup lid attached with a tea bag according to claim 8, further comprising a first guiding groove and a second guiding groove, wherein the first guiding groove is formed on the top surface of the lid body and extends from a bottom end of the recess toward the through hole, and the second guiding groove extends from a top end of the recess to a periphery of the lid body.

11. The cup lid attached with a tea bag according to claim 9, further comprising a first guiding groove and a second guiding groove, wherein the first guiding groove is formed on the top surface of the lid body and extends from a bottom end of the recess toward the through hole, and the second guiding groove extends from a top end of the recess to a periphery of the lid body.

12. The cup lid attached with a tea bag according to claim 7, further comprising a third guiding groove extending from the buckle groove to a periphery of the lid body in a direction away from the sip hole structure.

13. The cup lid attached with a tea bag according to claim 7, further comprising a partition board disposed below the top surface of the lid body and located inside the lid body, wherein an upper end of the partition board and the lid body are connected to each other between the sip hole structure and the through hole, the partition board comprises a first surface and a second surface opposite to the first surface, and the first surface faces the body.

14. The cup lid attached with a tea bag according to claim 13, further comprising at least one supporting plate located inside the lid body and respectively connected to the lid body and the partition board, wherein the supporting plate, the lid body and the partition board are located in different planes.

15. The cup lid attached with a tea bag according to claim 7, wherein a bottom portion of the lid body comprises a protruding outer edge, the protruding outer edge is provided with a hook portion, the label detaches from the label placement structure in a withdrawal state, and the label drags the drawstring to be attached to the hook portion to fix the label.

16. The cup lid attached with a tea bag according to claim 7, wherein an inner wall surface of the lid body comprises a threaded structure.

* * * * *